US012122587B1

(12) United States Patent
Yu

(10) Patent No.: US 12,122,587 B1
(45) Date of Patent: Oct. 22, 2024

(54) CARD STORAGE BOX

(71) Applicant: San Hon Yu, Hong Kong (CN)

(72) Inventor: San Hon Yu, Hong Kong (CN)

(73) Assignee: San Hon Yu, Hong Kong (CN)

( * ) Notice: Subject to any disclaimer, the term of this patent is extended or adjusted under 35 U.S.C. 154(b) by 0 days.

(21) Appl. No.: 18/633,505

(22) Filed: Apr. 11, 2024

Related U.S. Application Data

(63) Continuation of application No. PCT/CN2024/083303, filed on Mar. 22, 2024.

(30) Foreign Application Priority Data

Mar. 27, 2023 (CN) ..... 202320639470.7

(51) Int. Cl.

| | |
|---|---|
| ***A45C 11/18*** | (2006.01) |
| ***B65D 43/16*** | (2006.01) |
| ***B65D 43/22*** | (2006.01) |
| ***B65D 43/24*** | (2006.01) |
| ***B65D 83/00*** | (2006.01) |
| ***B65D 85/62*** | (2006.01) |

(52) U.S. Cl.
CPC ..... *B65D 83/0038* (2013.01); *B65D 43/163* (2013.01); *B65D 43/22* (2013.01); *B65D 43/24* (2013.01); *B65D 85/62* (2013.01); *B65D 2543/00194* (2013.01)

(58) Field of Classification Search
CPC . B65D 83/0038; B65D 83/0829; A45C 11/18; A45C 11/182; B42F 17/00; B42F 17/02; B42F 17/18
USPC ..... 206/39, 39.4, 425, 804
See application file for complete search history.

(56) References Cited

U.S. PATENT DOCUMENTS

| | | | | |
|---|---|---|---|---|
| 4,471,885 | A * | 9/1984 | Mucciarone | B42F 17/18 221/281 |
| 4,792,058 | A * | 12/1988 | Parker | B65D 83/12 221/232 |
| 5,125,505 | A * | 6/1992 | Kurosaki | G09F 3/18 206/556 |
| 7,347,325 | B2 * | 3/2008 | O'Neill | A45C 1/06 206/39 |
| 2007/0045148 | A1 * | 3/2007 | Saclier | B65D 75/5805 206/499 |
| 2014/0014676 | A1 * | 1/2014 | Minson | A45C 11/182 221/226 |
| 2019/0387853 | A1 * | 12/2019 | Chan | A45C 11/18 |

* cited by examiner

*Primary Examiner* — Luan K Bui
(74) *Attorney, Agent, or Firm* — Buchalter; Jason W. Croft

(57) ABSTRACT

A card storage box is disclosed. The card storage box includes a housing having a cavity, where the housing is provided with an opening at a top, a clamping plate is slidably connected to a side wall of the housing and partially extends out of the opening, a card pushing member is rotatably connected to the housing and positioned at a bottom of the cavity. The card storage box further includes a cover body, where the cover body is rotatably connected to the housing, and the cover body can cover the opening. A limiting groove is provided in an inner wall of the cover body, when the cover body covers the housing, the clamping plate is clamped with the limiting groove, and the clamping plate abuts against a groove wall of the limiting groove to limit a rotation of the cover body.

10 Claims, 6 Drawing Sheets

CARD STORAGE BOX

CROSS-REFERENCE TO RELATED APPLICATION

This application is a bypass continuation of international application number PCT/CN2024/083303, filed Mar. 22, 2024, which claims priority to Chinese patent application No. 202320639470.7 filed Mar. 27, 2023. The contents of these applications are incorporated herein by reference in their entirety.

TECHNICAL FIELD

The present disclosure relates to the technical field of storage tools, and in particular, to a card storage box.

BACKGROUND

With the development of modern society, various cards such as bank cards, shopping cards and membership cards are used by people. However, due to the current popularity of electronic payment, people do not need to bring wallets. Therefore, carrying and storing cards has become a challenge, and can even bring many troubles such as card loss or difficulty in finding cards.

In the related technology, there are card holders and card boxes specially used to store cards, which are usually provided with openings for conveniently taking. However, with reduction in a holding and restricting effect of the card box after long-term use or damage caused by human factors, the cards are easy to fall and lose, which is not conducive to the use experience of a user. However, the provision of a cover body to prevent the cards from falling off cannot meet a requirement of a user for conveniently taking the cards.

SUMMARY

To at least solve one of the technical problems in the existing technology, the present disclosure provides a card storage box, which is provided with a closed cover body that can prevent a card from falling off, and can facilitate users to store and take the cards and improve use experience of the users.

According to a first aspect of the present disclosure, an embodiment provides a card storage box, including a housing having a cavity, where the housing is provided with an opening at a top, a clamping plate is slidably connected to a side wall of the housing and partially extends out of the opening, a card pushing member is rotatably connected to the housing and is positioned at a bottom of the cavity, and a magnet is arranged on the side wall of the housing. The card storage box further includes a cover body, where the cover body is rotatably connected to the housing and is capable of covering the opening, an inner wall of the cover body is provided with a limiting groove, when the cover body covers the housing, the clamping plate is clamped with the limiting groove, and the clamping plate abuts against a groove wall of the limiting groove to limit a rotation of the cover body. The inner wall of the cover body is connected to a limiting boss, the limiting boss is positioned at a side away from the limiting groove, when the clamping plate slides to be separated from the limiting groove, the cover body rotates to uncover the opening, and the card pushing member pushes a card to extend out.

The card storage box according to the embodiment of the present disclosure at least has the following beneficial effects: the opening is convenient for users to insert a card directly therethrough, and the cover body can cover the opening to limit the card from falling off and being lost. When placing a card, the user can directly insert the card into the cavity manually or rotate the cover body to move against the card to drive the card into the cavity, an end portion of the card abuts against the card pushing member and rotates the card pushing member toward the bottom of the cavity, and the cover body is locked through the clamping plate and the limiting groove, thereby completing the storage and placement of the card. The limiting boss is arranged from a top of the cover body toward the opening, such that the limiting boss can abut against a card of which a shape and a size do not support direct abutting against the cover body. When needing to take a card, the user only needs to separate the clamping plate from the limiting groove and then open the cover body, and the card pushing member pushes the card to partially extend out of the cavity and the opening, such that the user can take the card conveniently.

According to some embodiments of the present disclosure, the cover body is connected to the housing through a rotating shaft, the rotating shaft is sleeved with a first reset torsion spring, and the first reset torsion spring is connected to the housing and the cover body respectively.

According to some embodiments of the present disclosure, the clamping plate includes a first plate and a second plate. The first plate is arranged parallel to the side wall of the housing and positioned in the cavity, the second plate is connected to the first plate and extends out of the opening, the second plate extends toward an outside of the opening, and the second plate abuts against the groove wall of the limiting groove.

According to some embodiments of the present disclosure, the second plate is arranged inclinedly toward the outside of the opening, a periphery of the cover body is provided with an inclined guide surface. The inclined guide surface is adjacent to the limiting groove and is positioned at an outer side of the cover body relative to the limiting groove, and the inclined guide surface is configured to abut against the second plate arranged inclinedly to guide the clamping plate into the limiting groove.

According to some embodiments of the present disclosure, the clamping plate is connected to a sliding rod, the sliding rod penetrates through the side wall of the housing, one end of the sliding rod positioned in the cavity is connected to a sliding rod, and the other end of the sliding rod is connected to a button.

According to some embodiments of the present disclosure, the sliding rod is sleeved with a reset spring, and two ends of the reset spring are respectively connected to the button and the housing.

According to some embodiments of the present utility model, the card pushing member includes a first pushing plate and a second pushing plate which are arranged adjacent to each other, the first pushing plate is provided with a plurality of steps, and the plurality of steps are equidistantly and uniformly arranged on the side wall of the first pushing plate.

According to some embodiments of the present disclosure, the card pushing member is connected to the housing through a rotating rod, the rotating rod is sleeved with a second reset torsion spring, one end of the second reset torsion spring abuts against a bottom of the card pushing member, and the other end of the second reset torsion spring is connected to the housing.

According to some embodiments of the present disclosure, the side wall of the housing is provided with a friction rid positioned within the cavity and a plurality of friction plates. The friction rid is arranged on a surface of the plurality of friction plates, and the plurality of friction plates are detachably connected to the side wall of the housing.

According to some embodiments of the present disclosure, a surface of the housing is provided with a processing groove.

Additional aspects and advantages of the present disclosure will be set forth in part in the following description, some of which will be apparent from the following description, or will be learned by practice of the present disclosure.

BRIEF DESCRIPTION OF DRAWINGS

The present disclosure is further described below in conjunction with the accompanying drawings and embodiments.

REFERENCE NUMERALS

Figure 1:
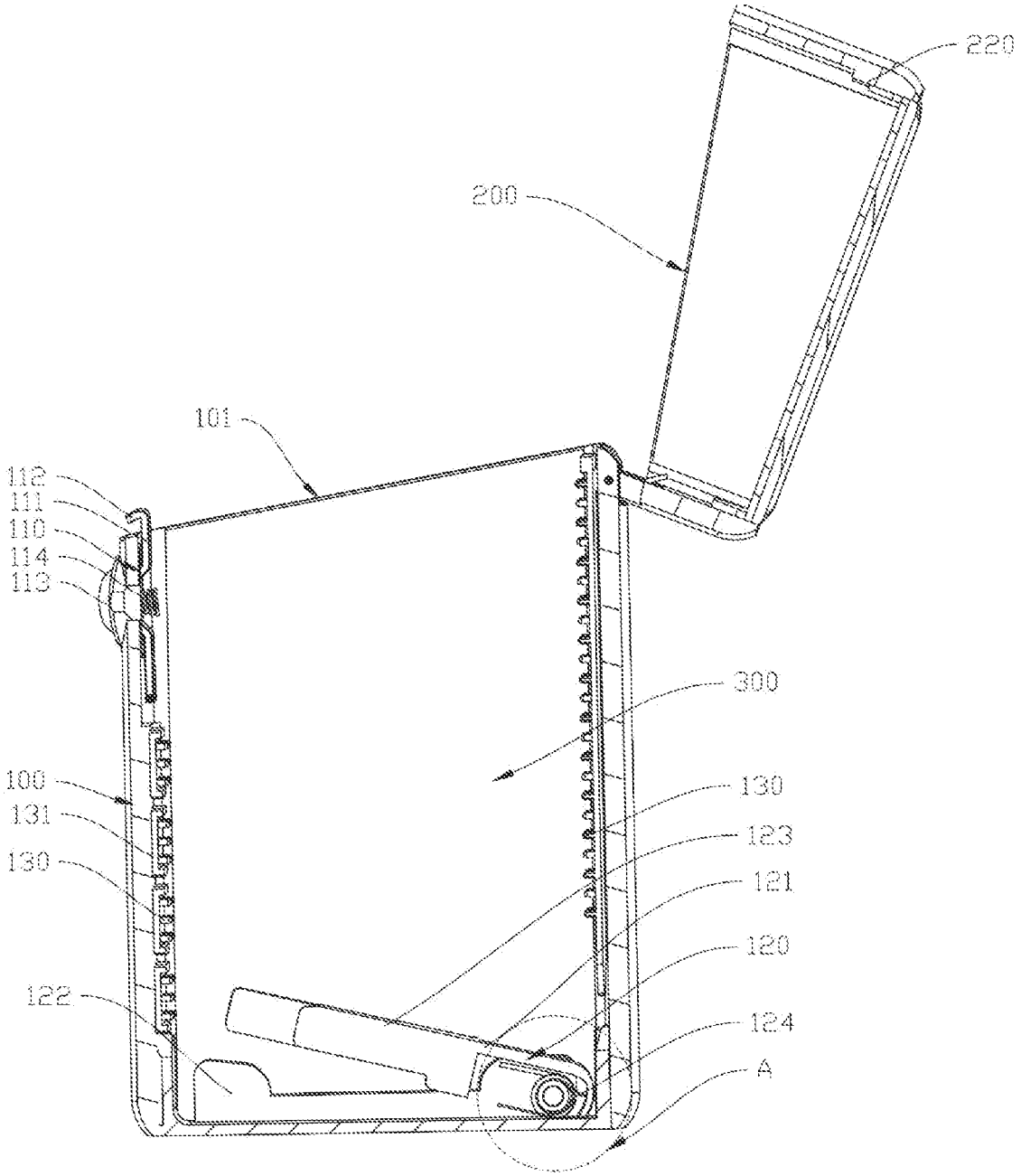
FIG. 1 is a schematic sectional view of a card storage box according to an embodiment of the present disclosure.

100: housing; 101: opening; 102: rotating shaft; 103: magnet; 104: processing groove; 110: clamping plate; 111: first plate; 112: second plate; 113: button; 114: reset spring; 120: card pushing member; 121: first pushing plate; 122: second pushing plate; 123: step; 124: second reset torsion spring; 130: friction rid; 131: friction plate; 200: cover body; 201: inclined guide surface; 202: first reset torsion spring; 210: limiting groove; 220: limiting boss; and 300: cavity.

DETAILED DESCRIPTION

Embodiments of the present disclosure will be described in detail below, and examples of the embodiments are shown in the accompanying drawings, where the same or similar reference numerals indicate the same or similar elements or elements having the same or similar functions throughout. The embodiments described below with reference to the accompanying drawings are illustrative only for the purpose of illustrating the present disclosure, and are not to be construed as limiting the present disclosure.

In the description of the present disclosure, it should be noted that orientational description, for example, orientational or positional relationships indicated by terms such as "upper", "lower", "front", "rear", "left", "right" should be construed to refer to the orientation as then described or as shown in the drawings under discussion. These relative terms are for convenience of description and do not require that the present disclosure be constructed or operated in a particular orientation, therefore cannot be construed to limit the present disclosure.

In the description of the present disclosure, the term "at least one" means one or more, the term "plurality of" (or multiple) means at least two, the term such as "greater than", "less than", "exceed" or variants thereof prior to a number or series of numbers is understood to not include the number adjacent to the term. If used herein, the terms such as "first", "second", and the like are merely used for distinguishing technical features, and are not intended to indicate or imply relative importance, or implicitly point out the number of the indicated technical features, or implicitly point out the precedence order of the indicated technical features.

In the description of the present disclosure, unless otherwise explicitly defined, unless otherwise explicitly defined, the terms such as "configure", "install/mount" and "connect" should be understood in a broad sense, and those having ordinary skills in the art can reasonably determine the specific meanings of the above terms in the embodiments of the present disclosure based on the specific contents of the technical schemes.

In the related technology, there are card holders and card boxes specially used to store cards, which are usually provided with open openings for conveniently taking. However, with reduction in a holding and restricting effect of the card box after long-term use or damage caused by human factors, the cards are easy to fall and be lost, which is not conducive to the use experience of a user. Besides, the provision of a cover body to prevent the cards from falling off cannot meet a requirement of a user for conveniently taking the cards.

Figure 2:
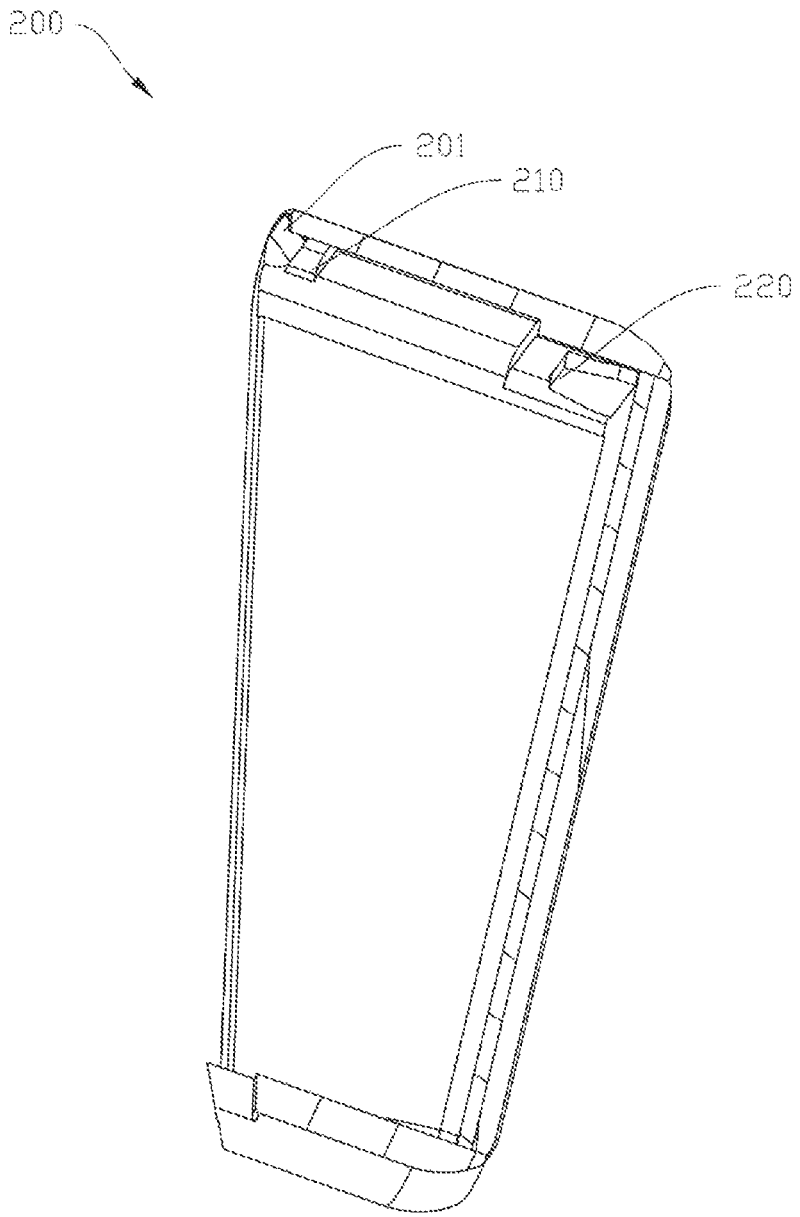
FIG. 2 is a schematic view of a cover body of the card storage box shown in FIG. 1.
Figure 5:
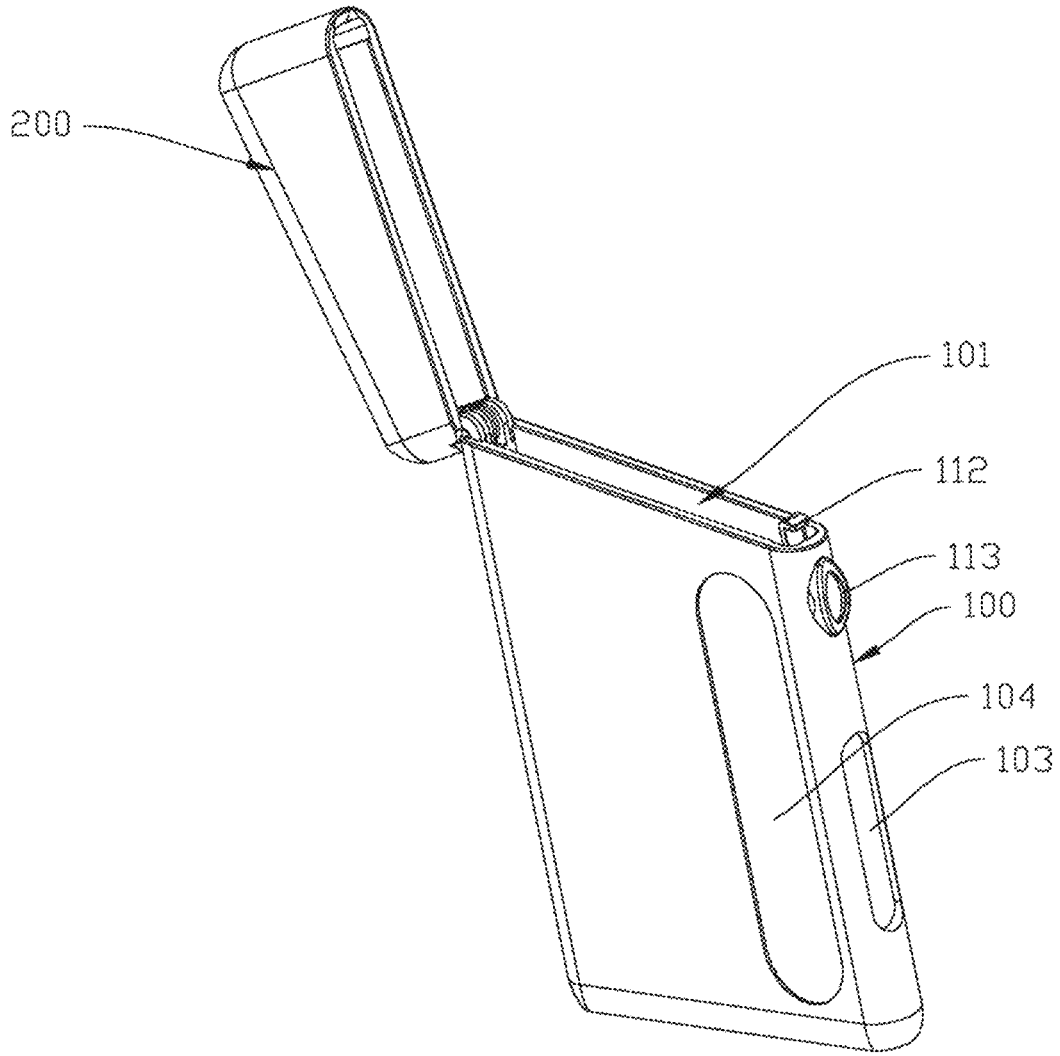
FIG. 5 is a schematic view of a card storage box according to an embodiment of the present disclosure.
Figure 6:
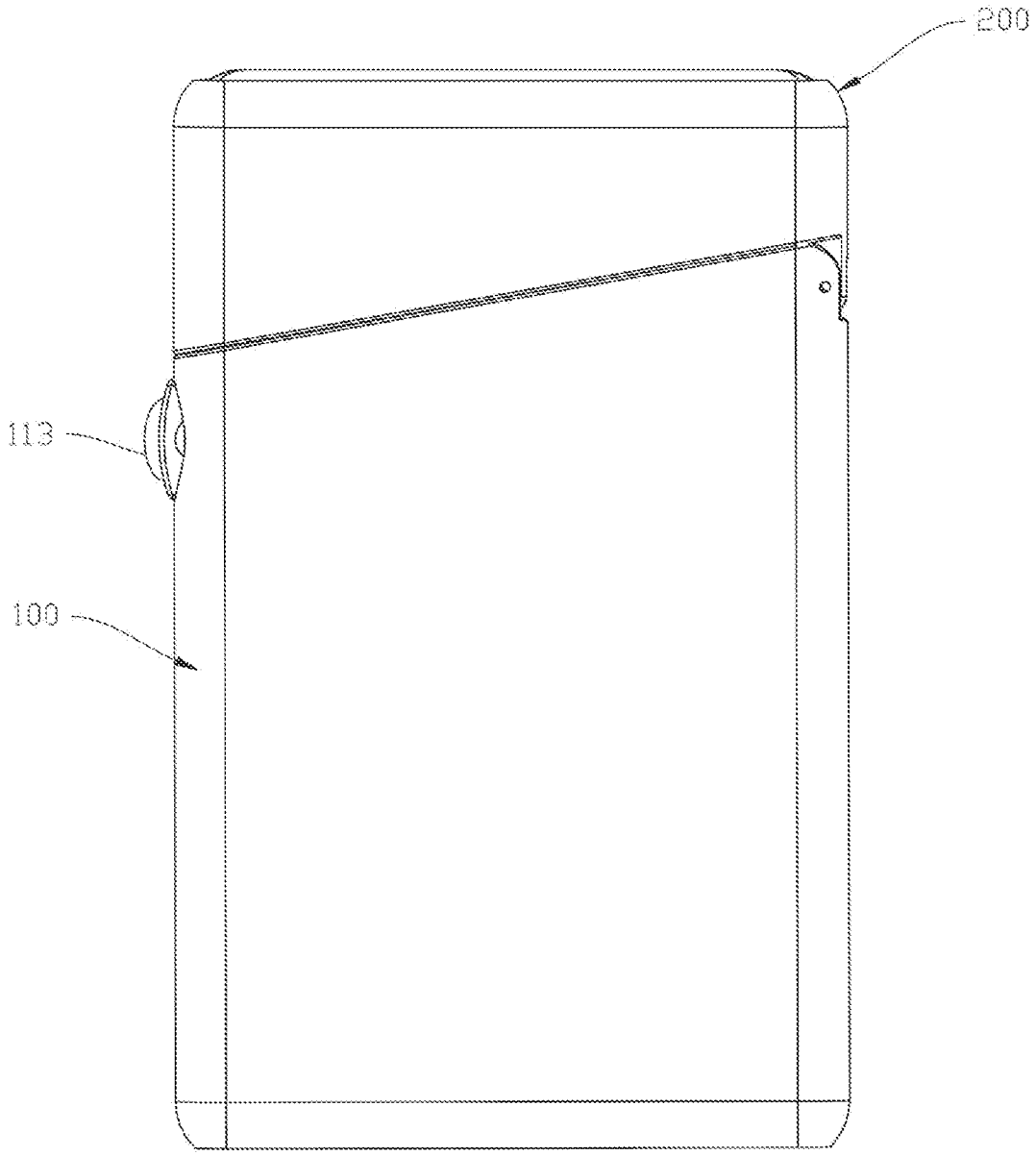
FIG. 6 is a schematic view of a card storage box when a cover body is in a covering state according to an embodiment of the disclosure.

Therefore, referring to FIGS. 1, 2 and 5, the present disclosure provides a card storage box, which includes a housing 100 having a cavity 300, and the housing 100 is provided with an opening 101 at a top thereof, which is convenient for the user to insert a card directly through the opening 101. The card storage box further includes a cover body 200. The cover body 200 is rotatably connected to the housing 100, and can cover the opening 101 to limit the card from falling off and being lost. It can be understood that a clamping plate 110 is slidably connected to a side wall of the housing 100 and partially extends out of the opening 101. A limiting groove 210 is provided in an inner wall of the cover body 200. When the cover body 200 covers the housing 100, the clamping plate 110 is clamped with the limiting groove 210, and the clamping plate 110 abuts against a groove wall of the limiting groove 210 to limit a rotation of the cover body 200. The clamping plate 110 cooperates with the limiting groove 210 to lock the cover body 200 and prevent the cover body 200 from automatically rotating to uncover the opening and causing the card to fall off. The side wall of the housing 100 is provided with a magnet 103, and the magnet 103 can be used to attach to iron products on a wallet of a user or to attach to the crotch of the user with hardware decorations, which is convenient for the user to carry, and can improve the appearance and meet the use requirements of the user. Referring to FIG. 5, an outer wall of the housing 100 is provided with a processing groove 104, which is aesthetic and exquisite, improves the contact area between the palm of the user and the housing 100, and provides a grasping position for the user to take the card conveniently. Further, the processing groove 104 is conducive to cooperating with a positioning mechanism to facilitate the overall assembly of the housing 100, which is beneficial for production.

Referring to FIG. 1, it should be noted that in addition to losing the card, the users are likely to lose the whole card storage box or forget the placement position of the card storage box. For this reason, in other embodiments of the present disclosure, the housing 100 can be provided with an anti-loss device, in which the anti-loss device is generally an ordinary electronic positioner with an integrated circuit and can be locked at the outside of the housing 100 through a locking member, including but not limited to the following arrangement: the locking member is provided with a convex portion enclosed with the housing 100 into a cavity, and the anti-loss device is arranged in the cavity; the convex portion is provided with an opening which is communicated with the cavity, and the opening is connected to a cover through a screw thread to close the cavity, so as to complete the fixation of the anti-loss device.

In other embodiments of the present disclosure, in order to realize the smoothness and integrity of the card storage box, the surface of the housing 100 is provided with a concave circular groove, and the shape and size of the circular groove match the shape and size of the anti-loss device, so that the anti-loss device can be completely embedded in the circular groove. The cover and the circular groove can be connected by threads, and the outer surface of the cover does not protrude out of the plane of the side of the housing 100 provided with the circular groove, and is preferably flush with the plane so as to prevent it from protruding out of the surface of the housing 100, thereby improving the integrity and smoothness of the appearance of the housing 100 and further improving the aesthetics of the whole card storage box and optimizing the user experience. In other embodiments, the anti-lost device can be assembled with a rectangular housing to ensure the integrity and aesthetics, or the anti-lost device can be embedded in any position of the housing 100 according to its shape and size, so as to meet the user's requirement for aesthetics.

In other embodiments of the present disclosure, the anti-lost device can choose a miniature integrated circuit with a small size which is similar to a mobile phone communication card. The side of the housing 100 is provided with a slot corresponding to the miniature integrated circuit and an inserting sheet inserted into the slot, and the inserting sheet is provided with a special-shaped slot matched with the anti-lost device for accommodating the anti-lost device, so that the anti-lost device can be completely inserted into the slot to be hidden in the side of the housing 100, thereby avoiding a whole bloated structure, reducing the external volume of the housing 100 and further facilitating portability and optimizing the user experience.

Referring to FIGS. 1, 2, 4 and 5, a card pushing member 120 is rotatably connected to the housing 100, and is positioned at a bottom of the cavity 300. The inner wall of the cover body 200 is connected to a limiting boss 220, and the limiting boss 220 is positioned at a side away from the limiting groove 210. A first reset torsion spring 202 is provided at a connection between the cover body 200 and the housing 100. When the clamping plate 110 slides to be separated from the limiting groove 210, the cover body 200 rotates to uncover the opening 101, and the card pushing member 120 pushes a card to extend out. It can be understood that the card pushing member 120 is normally arranged inclinedly in the cavity 300. When placing a card, the user can directly insert the card into the cavity 300 manually or rotate the cover body 200 to move against the card to drive the card into the cavity 300. An end portion of the card abuts against the card pushing member 120 and rotates the card pushing member 120 toward the bottom of the cavity 300, and the cover body 200 is locked through the clamping plate 110 and the limiting groove 210, thereby completing the storage and placement of the card. The limiting boss 220 is arranged from a top of the cover body 200 toward the opening 101, such that the limiting boss 220 can abut against a card of which a shape and a size do not support direct abutting against the cover body 200. It can be understood that two or more limiting bosses 220 with different heights and different widths are provided to facilitate the placement of cards with different specifications and sizes, thereby increasing the compatibility of the card storage box and optimizing the use of the user. When needing to take a card, the user only needs to separate the clamping plate 110 from the limiting groove 210 and then open the cover body 200, and the card pushing member 120 pushes the card to partially extend out of the cavity 300 and the opening, such that the user can take the card conveniently.

Figure 4:
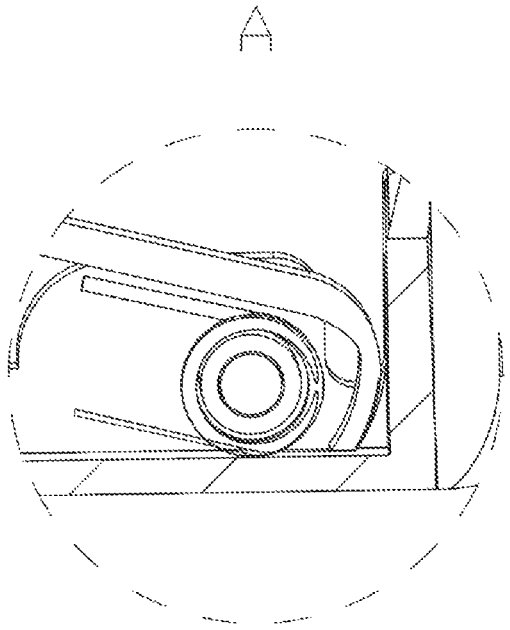
FIG. 4 is a partial enlarged view of A shown in FIG. 1.

Referring to FIG. 4, it should be noted that the card pushing member 120 is connected to the housing 100 through a rotating rod, and the rotating rod is sleeved with a second reset torsion spring 124. One end of the second reset torsion spring 124 abuts against a bottom of the card pushing member 120, and the other end of the second reset torsion spring is connected to the housing 110. Normally, one end of the second reset torsion spring 124 abuts against the card pushing member 120 and is in an inclined state. When the user places the card and pushes the card pushing member 120 to rotate toward the bottom of the housing 110, the second reset torsion spring 124 is driven to elastically deform and generate an elastic force. When the user controls the cover body 200 to uncover the opening, no pressure is exerted on the card and the card pushing member 120, so that the card pushing member 120 rotates toward the opening 101 under a pushing force generated by the elastic force of the second reset torsion spring 124, thereby driving the card to extend out of the opening 101, which is convenient for the user to take the card.

In addition, referring to FIG. 1, a shape and a size of the housing 100 may not match a shape and a size of the card, a width of the cavity 300 is at least greater than that of the card, and a side of the cover body 200 facing the housing 100 is provided with a second opening 101 that forms the cavity 300 with the opening 101 of the housing 100. In this case, the card can normally partially extend out of the opening 101 of the housing 100, and the card can be completely covered by the cover body 200. In this way, when the cover body 200 is opened, the majority of the card extends out of the cavity 300, which further facilitates the user to take the card.

Referring to FIGS. 1, 5, 6 and 7, it can be understood that the clamping plate 110 is connected to a sliding rod, the sliding rod penetrates through the side wall of the housing 100, one end of the sliding rod positioned in the cavity 300 is connected to a sliding rod, and the other end of the sliding rod is connected to a button 113. The user can press the button 113 to drive the clamping plate 110 to be separated from the limiting groove 210 to unlock the cover body 200, so that the operation of the user is simplified. Further, the sliding rod is sleeved with a reset spring 114, and two ends of the reset spring 114 are respectively connected to the button 113 and the housing 100. After the user presses the button, the reset spring 114 drives the button 113 to reset based on the elastic force resisting the elastic deformation, the user does not need to manually reset the button 113, and the use of the user is further simplified.

Figure 3:
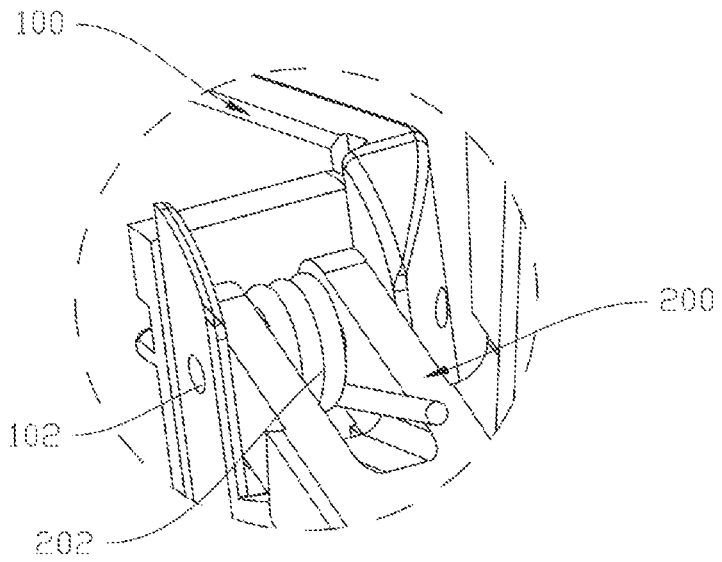
FIG. 3 is a partial enlarged view of the connection between a cover body and a housing of a card storage box according to an embodiment of the present disclosure.

Referring to FIGS. 1, 2 and 3, it can be understood that the cover body 200 is connected to the housing 100 through the rotating shaft 102, the rotating shaft 102 is sleeved with the first reset torsion spring 202, and the first reset torsion spring 202 is connected to the housing 100 and the cover body 200 respectively. The cover body 200 is normally in the open state. When the cover body 200 is in the covering state and the clamping plate 110 is separated from the limiting groove 210, the first reset torsion spring 202 drives the cover body 200 to automatically rotate and reset based on the elastic force resisting the elastic deformation, and the user does not need to manually open the cover body 200, which simplifies the opening action of the user and further facilitates the user to take the card.

Referring to FIGS. 1, 2, 6 and 7, it can be understood that the clamping plate 110 includes a first plate 111 and a second plate 112. The first plate 111 is arranged parallel to the side wall of the housing 100 and positioned in the cavity 300, the second plate 112 is connected to the first plate 111 and extends out of the opening 101, the second plate 112 extends toward the outside of the opening 101, and the second plate 112 abuts against the groove wall of the limiting groove 210. The first plate 111 is convenient for the user to drive the clamping plate 110 to unlock and open the cover body 200, and the second plate 112 extends toward the outside of the opening 101 to directly abut against the groove wall of the limiting groove 210 at an outer side of the opening 101, so as to further enhance the limiting effect of the covering state of the cover body 200. Therefore, the cover body 200 is stable and cannot be separated when covering, thereby ensuring that the card cannot fall off.

Further, referring to FIGS. 1 and 2, the second plate 112 is arranged inclinedly toward the outside of the opening 101, a periphery of the cover body 200 is provided with an inclined guide surface 201. The inclined guide surface 201 is adjacent to the limiting groove 210 and is positioned at an outer side of the cover body 200 relative to the limiting groove 210, and the inclined guide surface 201 is configured to abut against the second plate 112 arranged inclinedly to guide the clamping plate 110 into the limiting groove 210. The second plate 112 is inclinedly arranged to cooperate with the inclined guide surface 201, such that the covering of the cover body 200 is smooth, the user does not need to apply a large external force, the damage caused by the slipping of the clamping plate 110 when closing the cover body 200 can be prevented, and the use experience of the user is further optimized.

Referring to FIG. 1, it can be understood that the card pushing member includes a first pushing plate 121 and a second pushing plate 122 which are arranged adjacent to each other. The first pushing plate 121 is provided with a plurality of steps 123, and the plurality of steps 123 are equidistantly and uniformly arranged on the side wall of the first pushing plate 121. The first pushing plate 121 and the second pushing plate 122 are arranged adjacent to each other and are rotatably connected to the housing 100 through the same rotating rod. Two pushing plates arranged adjacently can increase the capacity of the card storage box to meet the use requirements of the user. It can be understood that the first pushing plate 121 is provided with a plurality of steps 123 to push the cards out by different lengths, so that the user can conveniently observe, select and take the cards, and the use experience of the user is improved. It can be understood that the second pushing plate 122 may be provided with a second step, and the second step is not overlapped with the step 123 of the first pushing plate 121, so as to expand the card storage box and meet the requirement of the user for taking the card.

Figure 7:
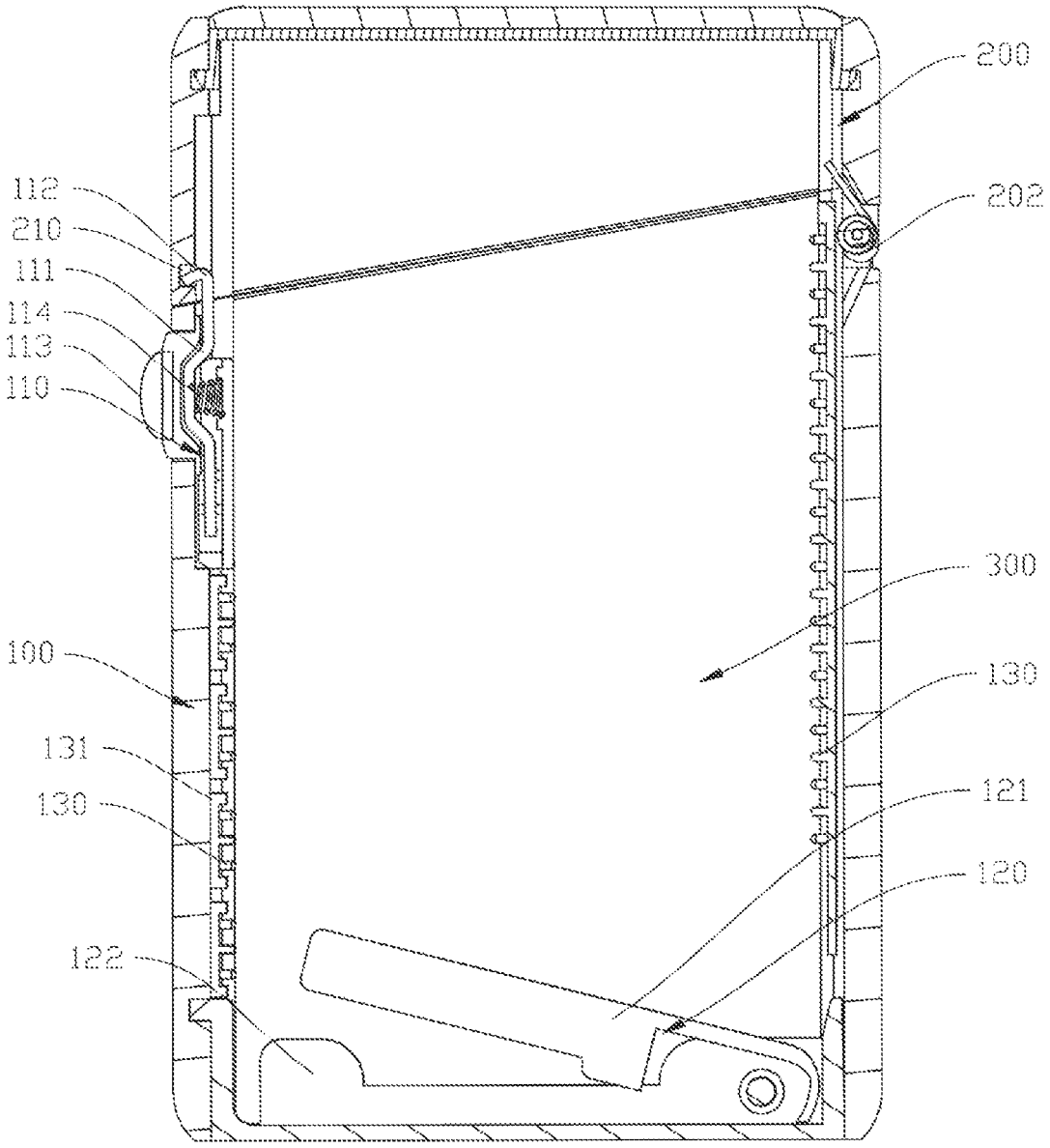
FIG. 7 is a schematic sectional view of FIG. 6.

Referring to FIGS. 1 and 7, the side wall of the housing 100 is provided with a friction rid positioned within the cavity 300. The friction rid is arranged on a surface of a friction plate 131. In an embodiment, a plurality of friction plates 131 are provided, and the plurality of friction plates 131 are detachably connected to the side wall of the housing 100. It can be understood that the friction rid abuts against the periphery of the card to slow down a speed at which the card pushing member 120 pushes the card out, thereby preventing the card from being directly pushed out by the card pushing member 120 when the user opens the cover body 200. It can be further understood that a plurality of detachable friction plates 131 may be flexibly provided based on the use habit of the user, so as to adjust the limitation of the friction rid to the extending speed of the card, thereby optimizing the use experience of the user. It can be understood that the friction rid is preferably made of heat-resistant and friction-resistant materials, so that the service life of the friction rid can be prolonged, and the use experience of the user is optimized.

The embodiments of the present disclosure have been described in detail with reference to the accompanying drawings, but the present disclosure is not limited to the foregoing embodiments. Various changes can be made within the knowledge of those having ordinary skills in the art without departing from the protection scope of the present disclosure.

What is claimed is:

1. A card storage box, comprising:

a housing having a cavity, wherein the housing is provided with an opening at a top, a clamping plate is slidably connected to a side wall of the housing and partially extends out of the opening, a card pushing member is rotatably connected to the housing and is positioned at a bottom of the cavity, and a magnet is arranged on the side wall of the housing;

a cover body rotatably connected to the housing, wherein the cover body is capable of covering the opening, an inner wall of the cover body is provided with a limiting groove, when the cover body covers the housing, the clamping plate is clamped with the limiting groove, and the clamping plate abuts against a groove wall of the limiting groove to limit a rotation of the cover body; and wherein the inner wall of the cover body is connected to a limiting boss, the limiting boss is positioned at a side away from the limiting groove, when the clamping plate slides to be separated from the limiting groove, the cover body rotates to uncover the opening, and the card pushing member pushes a card to extend out.

2. The card storage box of claim 1, wherein the cover body is connected to the housing through a rotating shaft, the rotating shaft is sleeved with a first reset torsion spring, and the first reset torsion spring is connected to the housing and the cover body respectively.

3. The card storage box of claim 1, wherein the clamping plate comprises a first plate and a second plate, the first plate is arranged parallel to the side wall of the housing and positioned in the cavity, the second plate is connected to the first plate and extends out of the opening, the second plate extends toward an outside of the opening, and the second plate abuts against the groove wall of the limiting groove.

4. The card storage box of claim 3, wherein the second plate is arranged inclinedly toward the outside of the opening, a periphery of the cover body is provided with an inclined guide surface, the inclined guide surface is adjacent to the limiting groove and is positioned at an outer side of the cover body relative to the limiting groove, and the inclined guide surface is configured to abut against the second plate arranged inclinedly to guide the clamping plate into the limiting groove.

5. The card storage box of claim 1, wherein the clamping plate is connected to a sliding rod, the sliding rod penetrates through the side wall of the housing, one end of the sliding rod positioned in the cavity is connected to a sliding rod, and the other end of the sliding rod is connected to a button.

6. The card storage box of claim 5, wherein the sliding rod is sleeved with a reset spring, and two ends of the reset spring are respectively connected to the button and the housing.

7. The card storage box of claim 1, wherein the card pushing member comprises a first pushing plate and a second pushing plate, the first pushing plate and the second pushing plate are arranged adjacent to each other, the first pushing plate is provided with a plurality of steps, and the plurality of steps are equidistantly and uniformly arranged on the side wall of the first pushing plate.

8. The card storage box of claim 7, wherein the card pushing member is connected to the housing through a rotating rod, the rotating rod is sleeved with a second reset torsion spring, one end of the second reset torsion spring abuts against a bottom of the card pushing member, and the other end of the second reset torsion spring is connected to the housing.

9. The card storage box of claim 1, wherein the side wall of the housing is provided with a friction rid positioned within the cavity and a plurality of friction plates, the friction rid is arranged on a surface of the plurality of friction plates, and the plurality of friction plates are detachably connected to the side wall of the housing.

10. The card storage box of claim 9, wherein a surface of the housing is provided with a processing groove.

* * * * *